US005816016A

United States Patent [19]

Zarnick

[11] Patent Number: 5,816,016

[45] Date of Patent: Oct. 6, 1998

[54] METHOD OF INSTALLING ACOUSTICAL PANELS IN AN ARENA

[76] Inventor: Bernard F. Zarnick, P.O. Box 16092, Rocky River, Ohio 44116

[21] Appl. No.: 570,351

[22] Filed: Dec. 11, 1995

[51] Int. Cl.[6] ..... E04G 21/14

[52] U.S. Cl. ..... 52/747.1; 52/741.1

[58] Field of Search ..... 52/747.1, 741.1, 52/745.2; 160/40, 184, 330, 332; 248/214, 215, 305

[56] References Cited

U.S. PATENT DOCUMENTS

| | | | |
|---|---|---|---|
| 2,633,321 | 3/1953 | Coulter | 248/215 |
| 2,673,990 | 4/1954 | Edwards | 248/215 |
| 3,111,981 | 11/1963 | Simbulan | 160/40 |
| 4,083,395 | 4/1978 | Romano | 160/330 |
| 4,894,935 | 1/1990 | Kreyz | 248/214 |
| 4,971,279 | 11/1990 | George | 248/214 |

FOREIGN PATENT DOCUMENTS

| | | | |
|---|---|---|---|
| 926634 | 4/1955 | Germany | 52/747.1 |

*Primary Examiner*—Michael Safavi

[57] ABSTRACT

A method of installing and hanging large acoustical panels in an arena by hanging the panels from I-beams in a ceiling area of the arena by suspending a worker from the I-beams by a harness and providing a tightrope for the worker to stand on whereby the worker can handle panels while being supported by the harness and the tightrope. The worker passes a hook end of a hook clip, attached at its opposite clip end to a panel, through a passage formed by a flute in a deck supported by the I-beams and engages the hook end with the opposite upper flange of an I-beam to hang the panel therefrom.

6 Claims, 2 Drawing Sheets

METHOD OF INSTALLING ACOUSTICAL PANELS IN AN ARENA

FIELD OF THE INVENTION

The present invention is directed to a method of installing and hanging acoustical panels in the ceiling area of a building such as an arena, to lower the crowd noise in the arena.

BACKGROUND OF THE INVENTION

In the construction of an arena with an open space 300–600 feet wide and 300–600 feet long, a roof encloses the building and a ceiling has a height exceeding 150 feet with trusses and I-beams supporting the roof deck. In completing the floor, a contractor lays concrete and puts in refrigeration for hockey and ice skating beside planning for a wooden floor for basketball. All of this make impossible the use of large motorized cranes on the new concrete. Thus the method of the present invention may be utilized to hang acoustical panels in a ceiling area to reduce noise in the arena. This is one of the last jobs to complete an arena so the conditions left by earlier contractors prevent the passage of large motorized cranes across newly laid concrete. If scaffolding is used to install ceiling acoustical panels in existing arenas, it results in blocking out seating sections which reduces revenues at ongoing events.

SUMMARY OF THE INVENTION

The present invention consists of a method of installing acoustical panels which may be as large as 10 feet by 40 feet in length, 150 feet in the air below the ceiling I-beams of an arena. The ceiling I-beams may extend 300 feet or more across the arena. A worker or rigger stands on a tightrope while being suspended by a body harness attached to a lower flange of an I-beam. In that position, the worker manhandles a 40 pound acoustical panel to pass a hook clip which consists of a 1"–1½" metal strip with a bend section of metal at a hook end over an I-beam and through a passageway formed by a flute in a deck above the I-beam and the hook end is attached to an upper flange of the I-beam. One or more hook clips may be used per panel. The hook clip also has a clip end for attachment to a grommet in a panel.

The panels may be hoisted from the floor to the worker or rigger 150 feet in the air or passed to the rigger from a catwalk. The rigger also may have a motorized power source attached to the lower edge of the I-beam to raise the panel from the floor. The rigger repositions his body harness and support and walks along the tight rope to the next position for hanging a panel until all the panels from a single setting of the tightrope have been completed.

DESCRIPTION OF THE PREFERRED EMBODIMENT

Figure 1:
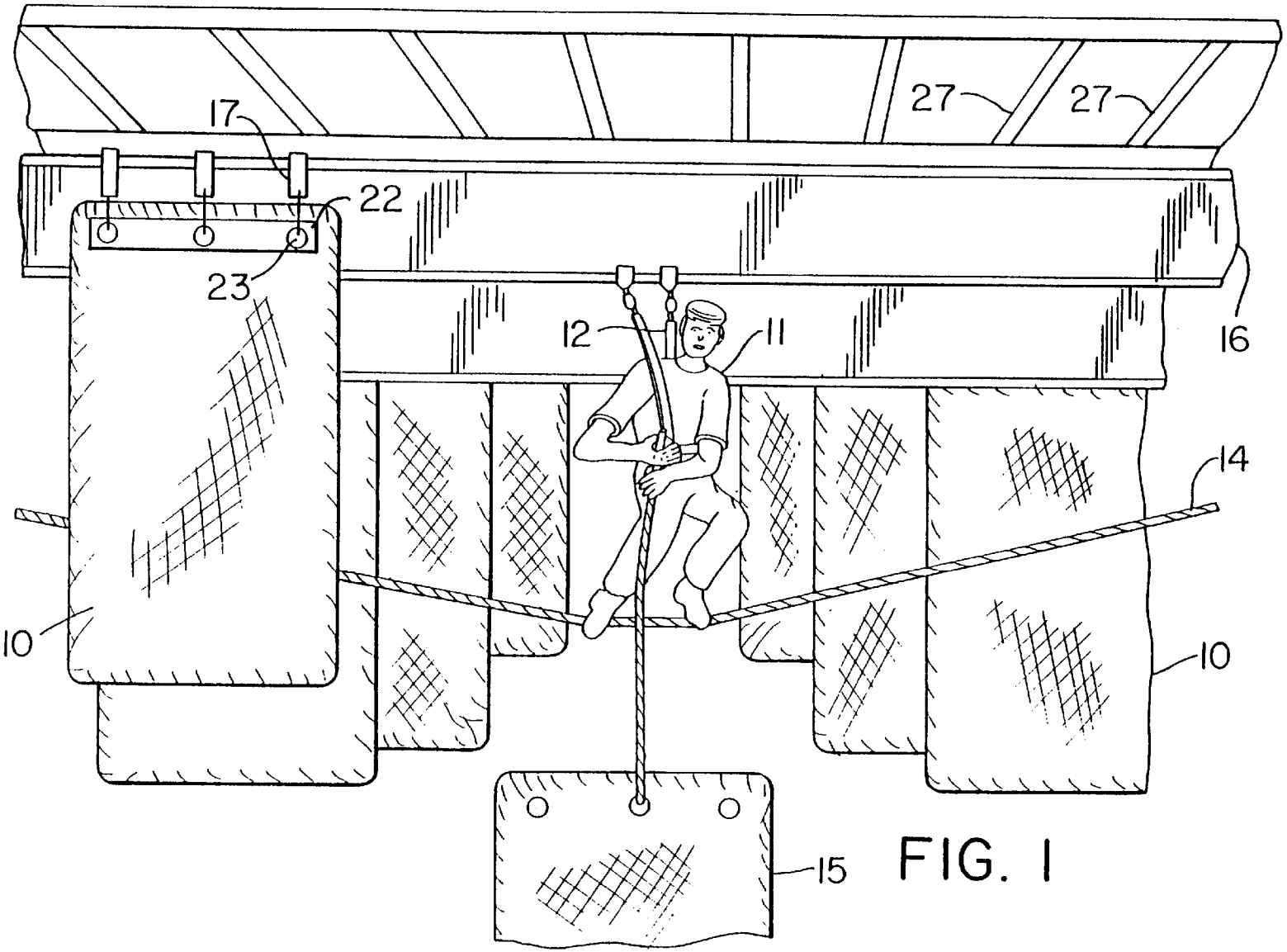
FIG. 1 is an assembly drawing of the rigger in position on a tightrope attached to an I-beam with a body harness and ready to install panels in the arena.
Figure 2:
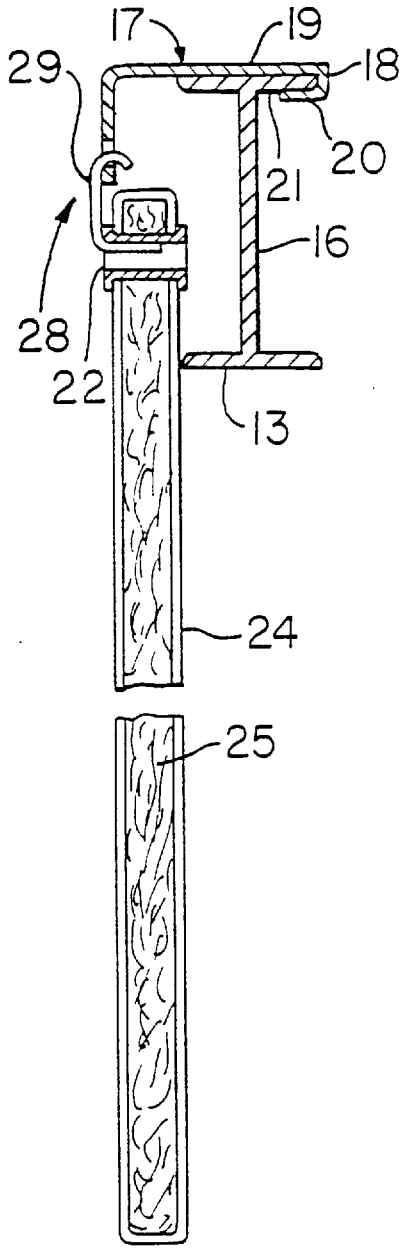
FIG. 2 is a cross section of an I-beam with a hook clip around the I-beam locked onto the I-beam's upper flange and holding the panel in a hanging position from the I-beam.

Acoustical panels (10) are hung by a worker or rigger (11). The rigger is supported in a body harness (12) attached to a lower flange of an I-beam. The rigger stands on a tight rope (14) temporarily suspended below the I-beam across the arena.

The rigger's job is to position an acoustical panel (15) which he is pulling so that he can stand on the tight rope, reach over an I-beam (16) and pass the hook clip (17) over the I-beam and lock the hook end (18) on the opposite upper flange of the I-beam so that the weight of the acoustical panel (15) holds the hook end (18) securely on the flange. Preferably the hook end is bent so that the sides of the hook end (19) and (20) grip the upper flange.

The hook clip (17) is secured to the panel by means of clip end (28) which passes through a grommet (23) in a hook strip or stiffen gripper (22). The clip end comprises a rigid bent portion 29 one end of which fits within grommet 23 and another end of which fits within an opening in the hook clip 17. The panels are covered with fabric or plastic film (24) and enclose acoustical material (25), which is very light.

The hook clips pass through passages formed by flutes of a deck some of which are shown at (27). Otherwise the deck is flush on the I-beams.

Having thus explained my invention I do not mean to be limited more than the claims which follow.

I claim:

1. A method of installing acoustical panels in a ceiling area of an arena, said ceiling area having a plurality of parallel I-beams therein, each having upper and lower flanges, comprising the steps of:

a) suspending a tightrope across a portion of the arena at a position below said I-beams;

b) supporting a worker at a position above said tightrope by a body harness suspended from one of said I-beams whereby said worker stands on said tightrope;

c) hoisting each panel up to a position to be grabbed by said worker; and d) connecting each panel to one of said I-beams by hook means.

2. A method according to claim 1, wherein each panel has at least one grommet extending therethrough and said hook means comprises a hook clip having a hook end for engagement with an upper flange of an I-beam and an opposite clip end for engagement with said grommet, said method further including the steps of engaging said upper flange with said hook end and engaging said grommet with said clip end.

3. A method according to claim 2, wherein each panel includes a plurality of grommets extending therethrough and an equal plurality of hook clips for engaging said I-beam and said grommets, said method further including the steps of engaging said I-beam and each of said grommets with a hook clip.

4. A method according to claim 1, which further includes the step of suspending said harness from a lower flange of said one of said I-beams.

5. A method according to claim 4, wherein said arena has a fluted deck supported by said I-beams with flutes extending perpendicular to said I-beams to form passageways over said I-beams and said method further includes the steps of passing said hook ends over the tops of said I-beams through said passageways and securing said hook ends to said upper flanges of said I-beams.

6. A method of installing acoustical panels in a ceiling area of an arena, said ceiling area having a plurality of I-beams therein, each having upper and lower flanges, said arena further having a fluted deck supported by said I-beams with flutes extending perpendicular to said I-beams to form passageways over said I-beams, each of said panels having a plurality of grommets extending therethrough, said method comprising the steps of:

a) suspending a tightrope across a portion of said arena at a position below said I-beams;

b) supporting a worker at a position above said tightrope by a body harness suspended from one of said I-beams whereby said worker stands on said tightrope;

c) hoisting each panel up to a position to be grabbed by said worker; and d) connecting each panel to one of said I-beams by hook clips, each of said hook clips having a hook end for engagement with an upper flange of said I-beam and a clip end for engagement with a grommet whereby said hook ends are passed over tops of said I-beams through said passageways and secured to said upper flanges of said I-beams and said clip ends are clipped to said panels through said grommets.

* * * * *